US008196495B2

(12) United States Patent
Chen

(10) Patent No.: US 8,196,495 B2
(45) Date of Patent: Jun. 12, 2012

(54) VERSATILE TOOL

(76) Inventor: Bo-Shen Chen, Taichung County (TW)

( * ) Notice: Subject to any disclaimer, the term of this patent is extended or adjusted under 35 U.S.C. 154(b) by 270 days.

(21) Appl. No.: 12/607,888

(22) Filed: Oct. 28, 2009

(65) Prior Publication Data

US 2010/0101380 A1 Apr. 29, 2010

(51) Int. Cl.
*B25B 23/12* (2006.01)
*B25B 13/02* (2006.01)

(52) U.S. Cl. ..... 81/437; 81/125

(58) Field of Classification Search ..... 81/436–438, 81/448, 124.4, 124.5, 125, 125.1, 184, 185, 81/177.2
See application file for complete search history.

(56) References Cited

U.S. PATENT DOCUMENTS 5,251,520 A * 10/1993 Lanham ..... 81/436
5,836,223 A * 11/1998 Lin ..... 81/436
6,418,821 B1 * 7/2002 Yamakawa ..... 81/437
6,598,500 B1 * 7/2003 Chivington ..... 81/124.5
7,481,136 B2 * 1/2009 Chiang ..... 81/184

* cited by examiner

*Primary Examiner* — Hadi Shakeri

(57) ABSTRACT

A versatile tool is driven by a drive tool and comprises a body defined with a through channel, two steel balls, two slide sleeves, and a rod member. The two slide sleeves are provided at both ends of the body, and the two steel balls are movably assembled in the through holes in two drive portions at both ends of the body, respectively and are capable of protruding into the channel. The rod member includes a magnetic end. When the rod member enters into the channel from either end of the body to be positioned by the corresponding steel ball, the drive space in the opposite end of the body can be used to assemble or disassemble multi-sized screws, simplifying the preparation procedure. In addition, the versatile tool can cooperate with different forms of tool heads or drills to increase its function.

6 Claims, 15 Drawing Sheets

VERSATILE TOOL

BACKGROUND OF THE INVENTION

1. Field of the Invention

The present invention relates to a tool; and more particularly to a versatile tool.

2. Description of the Prior Art

Screw is one of the important components in assembling operation, and the assembling operation sometimes requires the use of many different sized screws of the same shape. For example, the assembling operation of surfing board requires the use of surfing board screws of a special shape, and since the thickness of the surfing board and the lap positions between two surfing boards are different, the sizes of the used surfing board crews are also different.

However, different sized surfing board screws need different screwing tools. For example, at least three different sized surfing board screws, ¼ inch, 5/16 inch, ⅜ inch are required in the assembling operation of surfing board, so three different sized assembling/disassembling tools are required. Therefore, it is too inconvenient and heavy to prepare and carry so many tools In addition, since the above assembling/disassembling tools can be only used to assemble and disassemble the surfing board screws, therefore, the existing assembling/disassembling tools only have a single function and don't have any other addition functions.

The present invention has arisen to mitigate and/or obviate the afore-described disadvantages.

SUMMARY OF THE INVENTION

The primary objective of the present invention is to provide a versatile tool which can assemble/disassemble multi-sized screws to simplify the preparation procedure.

The secondary objective of the present invention is to provide a versatile tool which can cooperate with different forms of tool heads or drills to increase its function.

Hence, in order to achieve the above objectives, a versatile tool in accordance with the present invention comprises: a body, a first steel ball, a second steel ball, a first slide sleeve, a second slide sleeve and a rod member.

The body includes an axial through channel which is provided at both ends thereof with a first drive space and a second drive space that are hexagonal in cross section, on an outer periphery of the channel are provided a first drive portion and a second drive portion opposite to the first drive space and the second drive space, the second drive portion is hexagonal in cross section and defined with a through hole in an end corner thereof.

The second steel ball is movably assembled in the through hole of the second drive portion of the body and capable of protruding into the channel.

The first steel ball is movably assembled in the first drive portion of the body and capable of protruding into the channel.

The first slide sleeve includes an annular protrusion and is elastically engaged on the first drive portion of the body, and the annular protrusion is capable of pushing against the first steel ball;

The second slide sleeve is interiorly defined with a third drive space that is hexagonal in cross section, and an annular pushing portion, the third drive space and the pushing portion are arranged in a stepped manner, a radial size of the third drive space is greater than a radial size of the annular pushing portion, the annular pushing portion of the second slide sleeve is slidably engaged on the second drive portion of the body in such a manner that a moving space is defined between the third drive space and the second drive portion for movement of the second steel ball, the annular pushing portion is capable of pushing against the second steel ball, and the third drive space is capable of protruding from the second drive portion of the body.

The rod member is axially defined with more than one positioning concave and includes a magnetic end, one portion of the rod member is located in the channel of the body in such a manner that the positioning concave is positioned by the first steel ball, and the other portion of the rod member extends out of the channel of the body for connection to the drive tool.

by such arrangements, when the rod member enters the channel from the first drive portion of the body to make the positioning concave be positioned by the first steel ball and the magnetic end locate adjacent to the second drive space or the third drive space, the second drive space or the third drive space will be used to engage with a working object, when the rod member enters the channel from the second drive portion of the body to make the positioning concave be positioned by the first steel ball and the magnetic end locate adjacent to the first drive space, the first drive space will be used to engage with a working object.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
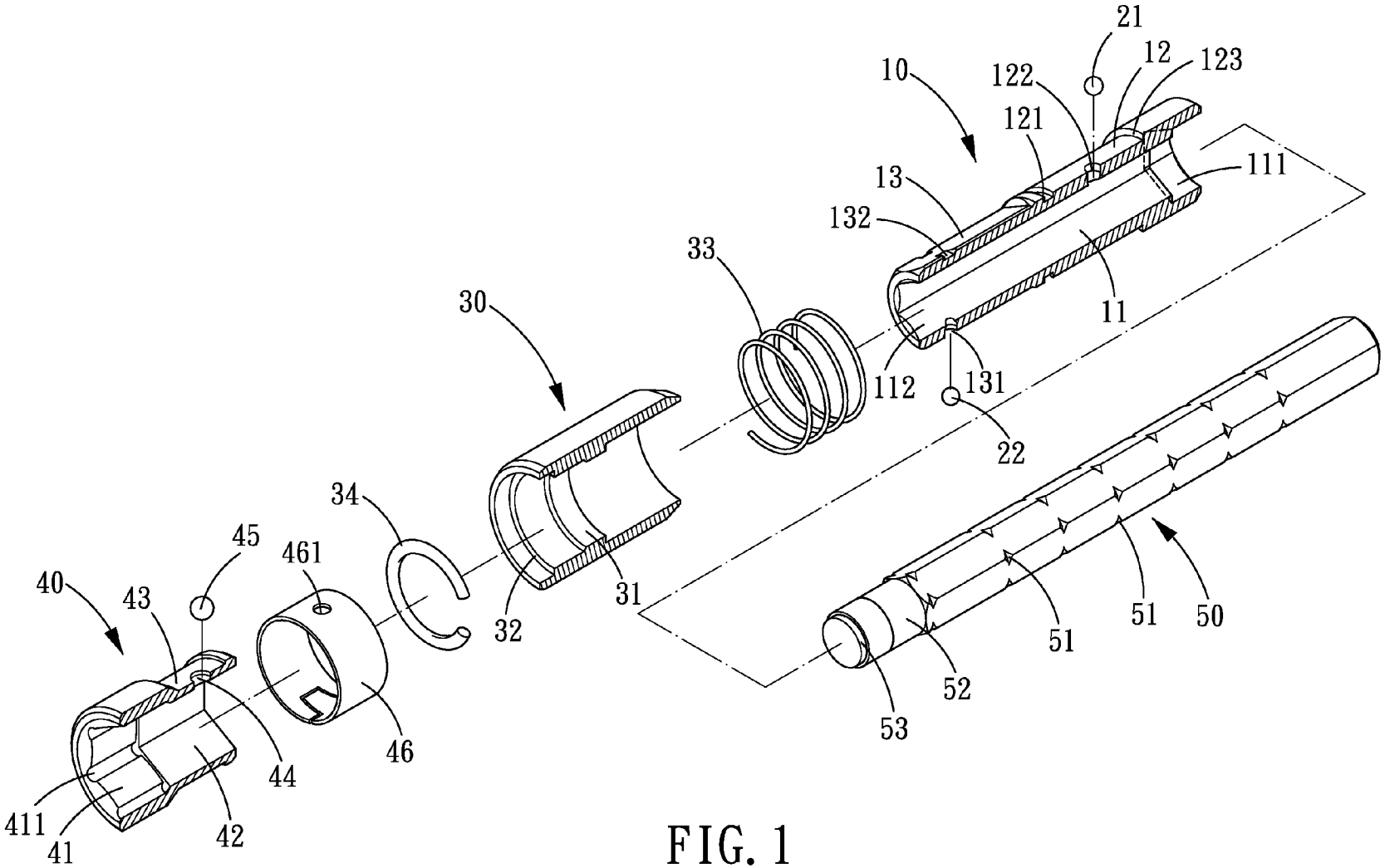
FIG. 1 is an exploded view of a versatile tool in accordance with a first embodiment of the present invention.
Figure 2:
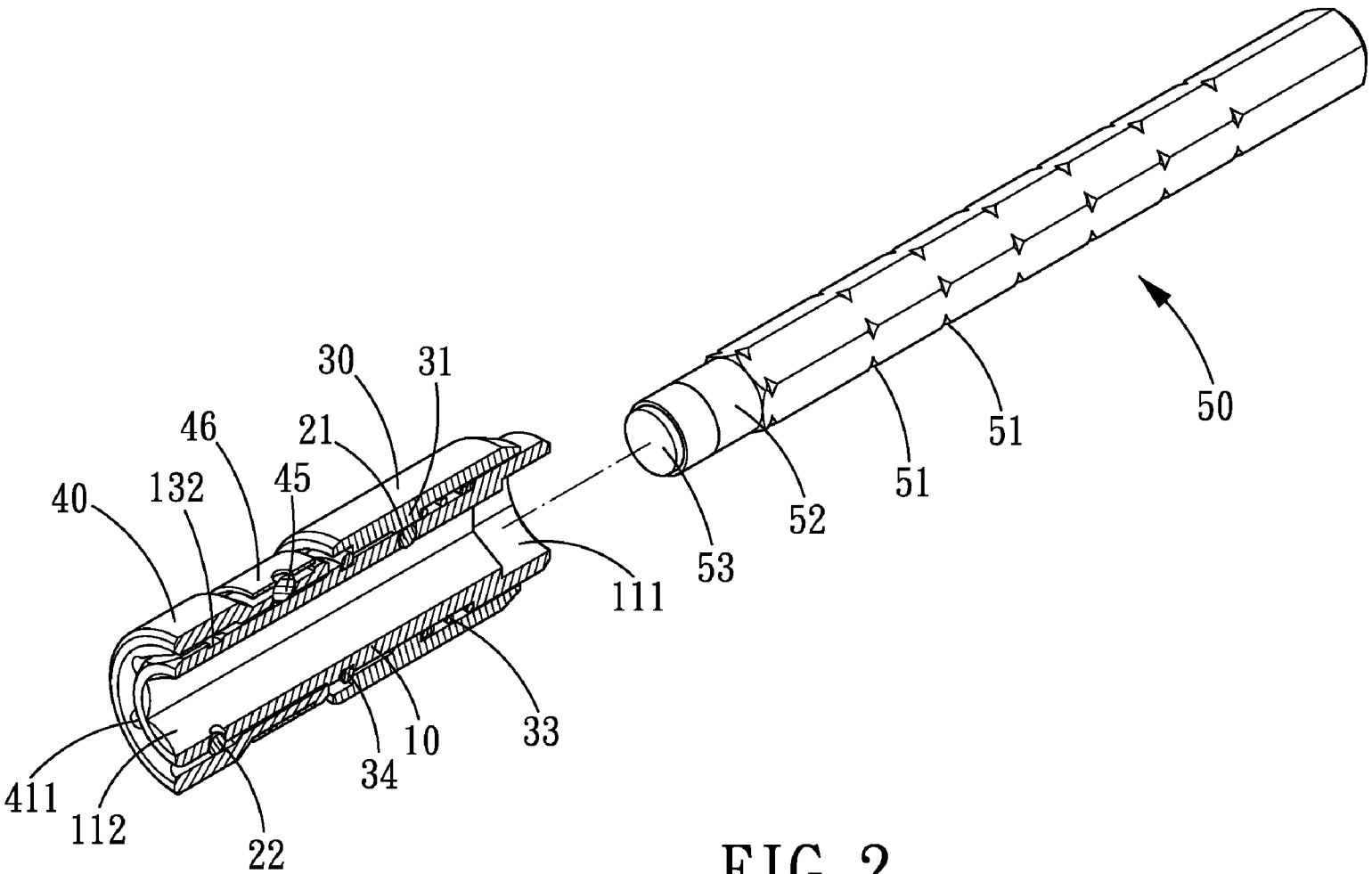
FIG. 2 is a perspective assembly view of the versatile tool in accordance with the first embodiment of the present invention, showing that all the components excluding the rod member are combined.
Figure 3:
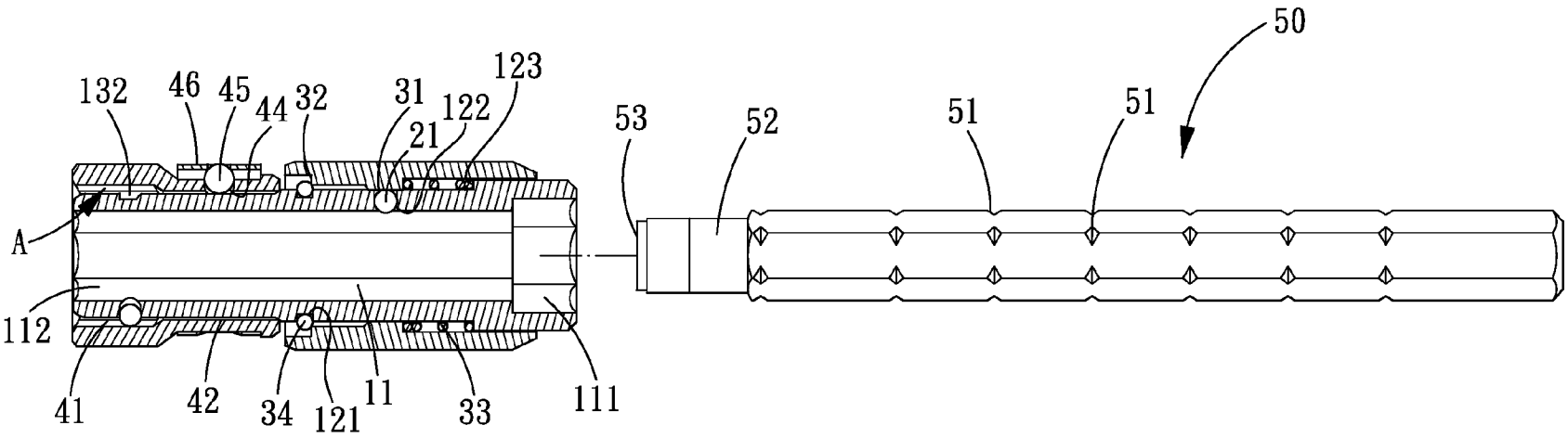
FIG. 3 is a cross-sectional view of the versatile tool in accordance with the first embodiment of the present invention, showing that all the components excluding the rod member are combined.

Referring to FIGS. 1-3, a versatile tool in accordance a first embodiment of the present invention is driven by a drive tool 100 and comprises, a body 10, a first steel ball 21, a first slide sleeve 30, a second steel ball 22, a second slide sleeve 40 and a rod member 50.

The body 10 includes an axial through channel 11. The through channel 11 is provided at both ends thereof with a first drive space 111 and a second drive space 112 that are hexagonal in cross section. The first drive space 111 and the second drive space 112 are arranged in a stepped manner, and the radial size of the first drive space 111 is greater than the radial size of the second drive, space 112. On an outer periphery of the channel 11 are provided a first drive portion 12 and a second drive portion 13 opposite to the first drive space 111 and the second drive space 112. The second drive portion 13 is hexagonal in cross section and defined with a through hole 131 in an end corner thereof, and an engaging groove 132 in another end corner opposite the end corner defined with the through hole 131. The first drive portion 12 includes an annular groove 121, a through hole 122 and an annular flange 123.

The first steel ball 21 is movably assembled in the through hole 122 of the first drive portion 12 of the body 10 and is capable of protruding in the channel 11.

The first slide sleeve 30 is interiorly provided with an annular protrusion 31 near a center of an inner periphery thereof, and an annular stopping portion 32 adjacent to the annular protrusion 31. The first slide sleeve 30 is elastically engaged on the first drive portion 12 of the body 10, and the annular protrusion 31 is capable of pushing against the first steel ball 21. Between the annular protrusion 31 and the annular flange 123 of the first drive portion 12 is disposed a spring 33 for pushing the first slide sleeve 30 back to its original position. In the annular groove 121 of the body 10 is disposed a snap, ring 34 correspondingly to the annular stopping, portion 32 of the first slide sleeve 30, preventing the first slide sleeve 30 from slipping from the body 10. It is to be noted that, when the first, slide sleeve 30 is not moved, the annular protrusion 31 just pushes against the first steel ball 21 to make the first steel ball 21 partially protrude into the channel 11. When the first slide sleeve 30 is moved, the annular protrusion 31 will be displaced away from the first steel ball 21 to allow the first steel ball 21 to completely retract into the through hole 122 of the body 10, namely, not protrude into the channel 11 any longer.

The second steel ball 22 is movably assembled in the through hole 131 of the second drive portion 13 of the body 10 and capable of protruding in the channel 11.

The second slide sleeve 40 is interiorly defined with a third drive space 41 that is hexagonal in cross section, and an annular pushing portion 42. The third drive space 41 and the pushing portion 42 are arranged in a stepped manner, that is to say, the radial size of the third drive space 41 is greater than the radial size of the annular pushing portion 42. The third drive space 41 is defined with a groove 411 in an end corner of an inner periphery thereof, and the groove 411 corresponds to the second steel ball 22. The annular pushing portion 42 of the second slide sleeve 40 is slidably engaged on the second drive portion 13 of the body 10 in such a manner that a moving space A is defined between the third drive space 41 and the second drive portion 13 for movement of the second steel ball 22. The annular pushing portion 42 is capable of pushing against the second steel ball, at the same time, the third drive space 41 will protrude from the second drive portion 13 of the body 10. The second slide sleeve 40 includes an engaging groove 43 in, an outer periphery of the annular pushing portion 42, and the engaging groove 43 includes a through hole 44 in a bottom thereof for movable accommodation of a third steel ball 45 which is capable of protruding out of the annular pushing portion 42. The engaging groove 43 is engaged with an elastic bind ring 46 which includes a pressing hole 461 for pressing against the third ball 45. By such arrangements, when the second slide sleeve 40 is pulled outwards toward the second drive portion 13 of the body 10, the third steel ball 45 will slide along a corresponding end corner on the outer periphery of the second drive portion 13 until it drops into the engaging groove 132 of the second drive portion 13, so that the second slide sleeve 40 cannot slide toward the second drive portion 13 of the body 10 but can be only pulled toward the first drive portion 12 of the body 10, preventing the second slide sleeve 40 from slipping from the body 10.

Figure 6:
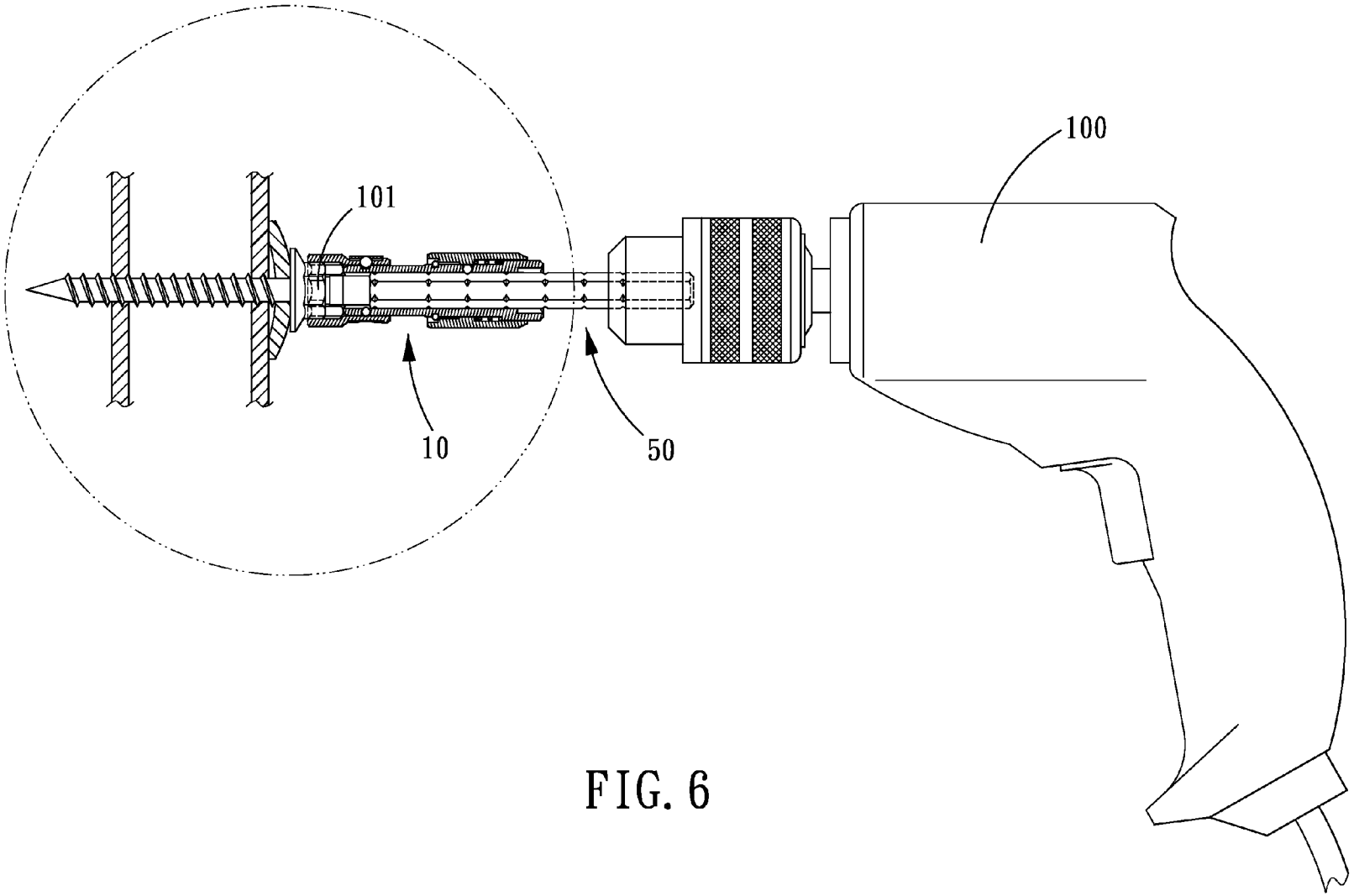
FIG. 6 shows the use of the third drive space of the versatile tool in accordance with the first embodiment of the present invention.

The rod member 50 is hexagonal in cross section and axially defined with seven positioning concaves 51 in each of end corners on an outer periphery thereof. The rod member 50 includes a magnetic end 52 which can be formed by magnetization of one end of the rod member 50. In the present embodiment, the rod member 50 is fixed with a magnet 53 at one end thereof to form the magnetic end 52. One portion of the rod member 50 is located in the channel 11 of the body 10 in such a manner that one of the positioning concaves 51 is engaged by the first steel ball 21 and positioned therein. The other portion of the rod member 50 extends out of the channel 11 of the body 10 for connection to the drive tool 100 (as shown in FIG. 6).

Hence, when the rod member 50 enters the channel 11 from the first drive portion 12 to make one of the positioning concaves 51 be engaged by the first steel ball 21 and the magnetic end 52 be located adjacent to the second drive space 112 or the third drive space 41, the second drive space 112 or the third drive space 41 will be used to engage with a working object. When the rod member 50 enters the channel 11 from the second drive portion 13 of the body 10 to make one of the positioning concaves 51 be positioned by the first steel ball 21 and the magnetic end 52 be located adjacent to the first drive space 111, the first drive space 111 will be used to engage with a working object.

The aforementioned is the summary of the positional and structural relationship of the respective components of the first embodiment in accordance with the present invention.

Figure 4:
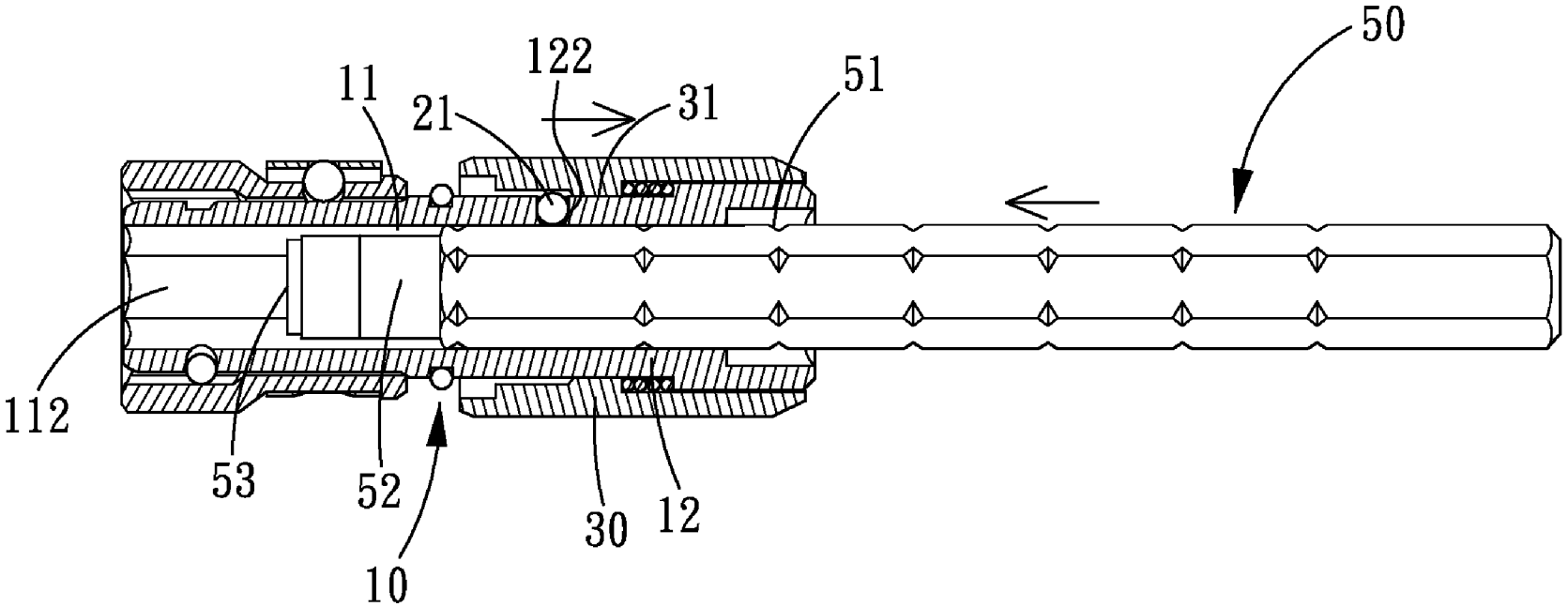
FIG. 4 is a first operational view of the versatile tool in accordance with the first embodiment of the present invention, showing that the first slide sleeve is pulled and the rod member is inserted into the body.
Figure 5:
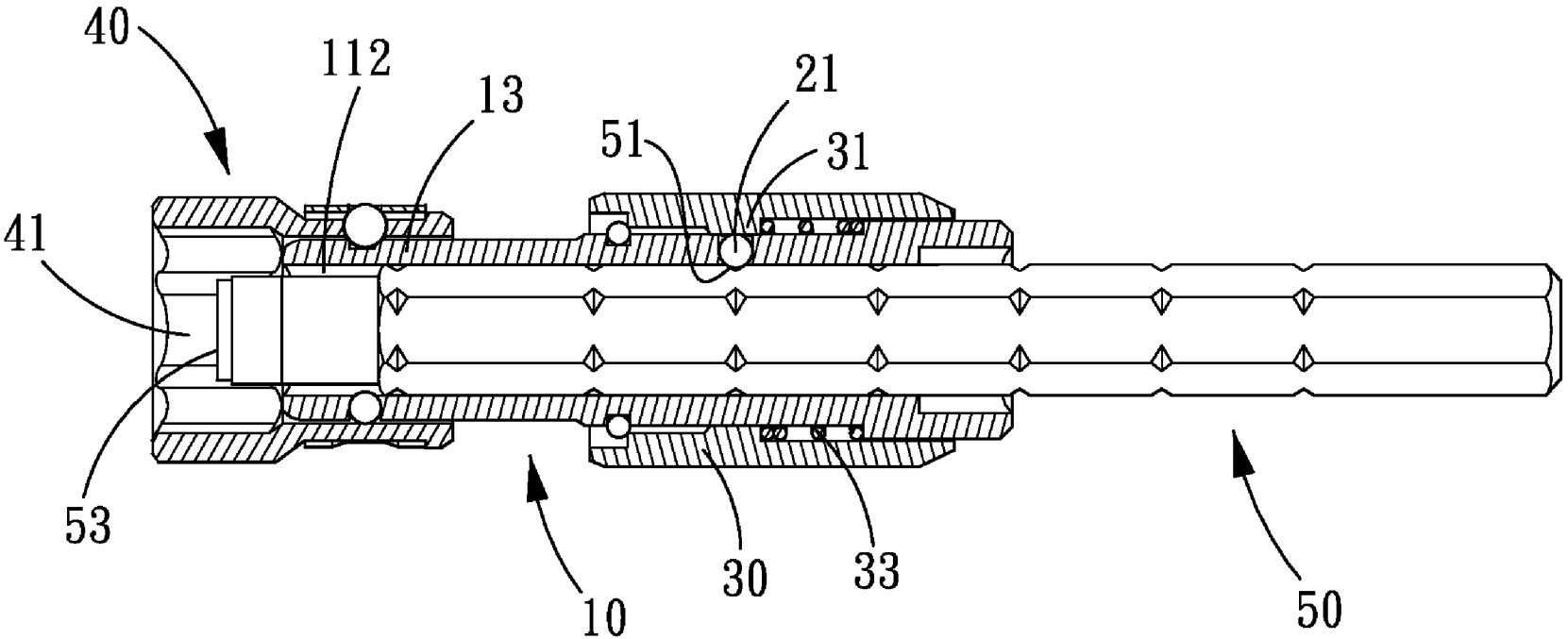
FIG. 5 is a second operational view of the versatile tool in accordance with the first embodiment of the present invention, showing that the rod member is positioned after beings inserted into the body.

For a better understanding of the present invention, its operation and function, reference should be made to the following description:

1. In terms of the use of the third drive space 41: please refer to FIGS. 4-5, firstly, the first slide sleeve 30 is pulled toward the first drive portion 12 of the body 10 to make the first, steel ball 21 be not pushed by the annular protrusion 31 any longer and completely retract into the through hole 122 of the body 10, at this moment, the magnetic end 52 of the rod member 50 will be inserted into the channel 11 toward the first drive portion 12 to align the positioning concaves 51 of the rod member 50 with the first steel ball 21 and make the magnet 53 of the magnetic end 52 protrude out of the second drive space 112, at the same time, one portion of the rod member 50 extends out of the channel 11 of the body 10.

Subsequently, the first slide sleeve 30 will be released and then return to its original position under the action of the elastic force of the spring 33, at the same time, the annular protrusion 31 will push against the first, steel ball 21 to position it in one of the positioning concaves 51 so as to combine the body 10 with the rod member 50 integrally.

Figure 7:
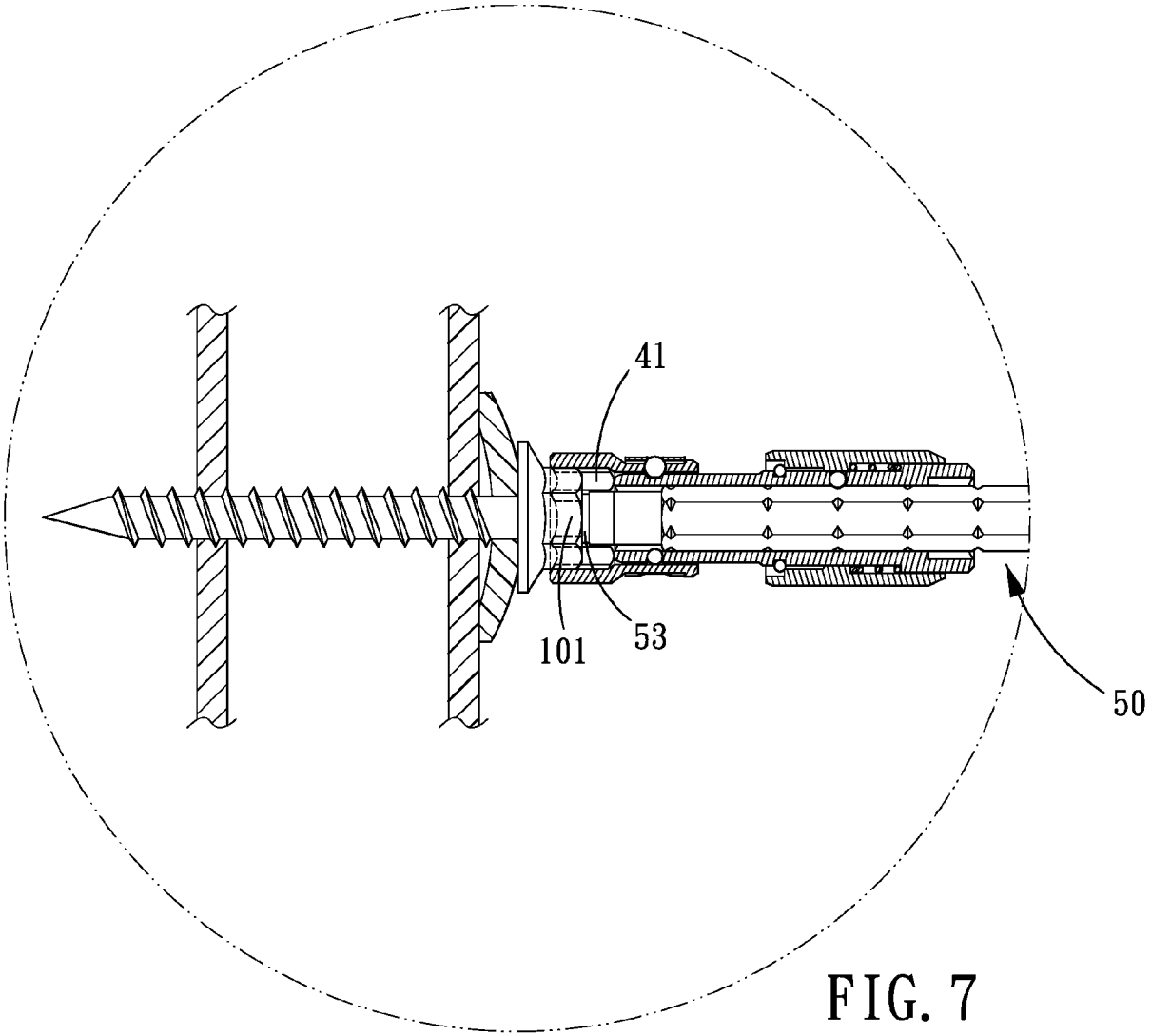
FIG. 7 is a partial enlarged view of FIG. 6.

Finally, the second slide sleeve 40 will be pulled outwards toward the second drive portion 13 to make the third drive space 41 protrude from the second, drive portion 13 of the body 10 and the magnet 53 of the rod member 50 locate in the third drive space 41, by such arrangements, as shown in FIGS. 6 and 7, the third drive space 41 can be engaged with a corresponding size of screw 101 (⅜ inch), and the rod member 50 which extends out of the channel 11 of the body 10 can be driven by the drive tool 100 to perform the assembling/disassembling operation. It is to be noted that, since the magnet 53 of the rod member 50 is located in the third drive space 41, after the disassembling operation is finished, the magnet 53 can attract the disassembled screw 101, likewise, before the assembling operation is performed, the screw 101 can be disposed in the third drive space 41 and attracted by the magnet 53 for facilitating the assembling operation.

Figure 8:
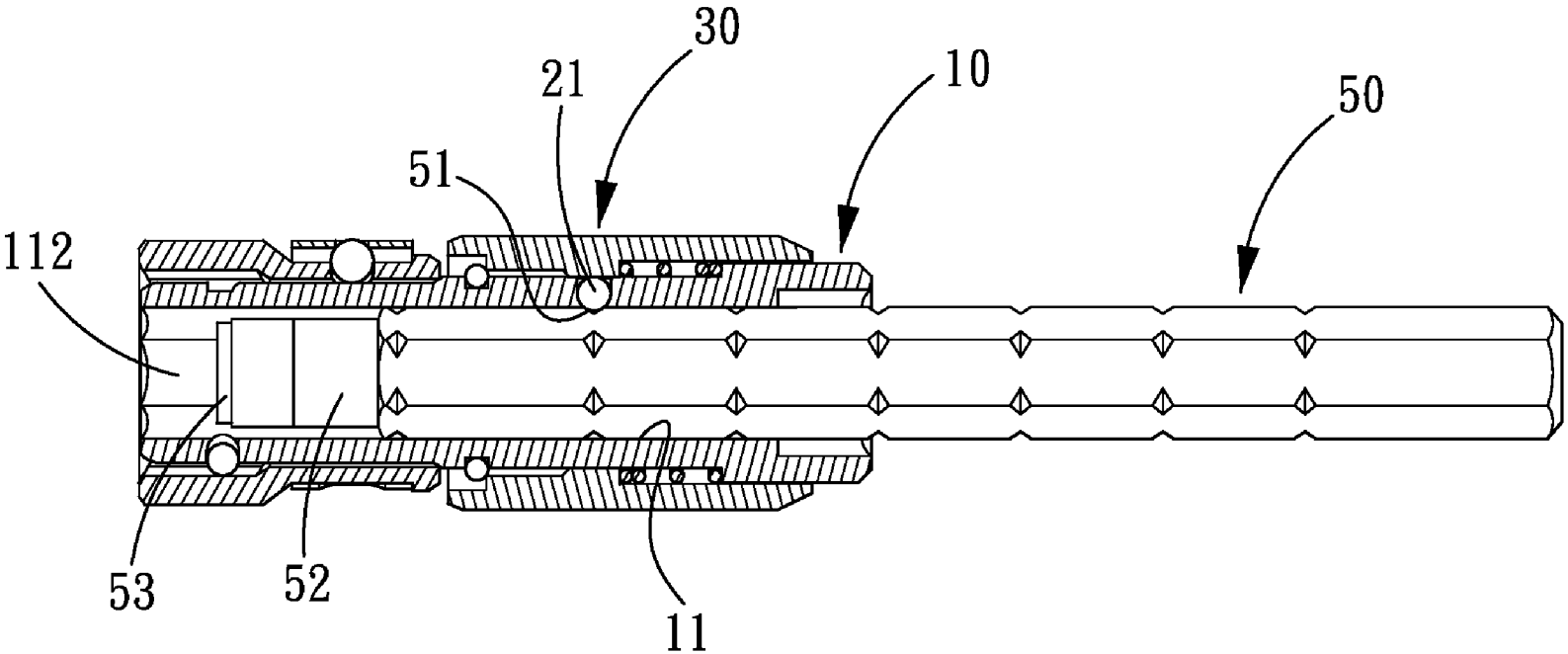
FIG. 8 is a third operational view of the versatile tool in accordance with the first embodiment of the present invention, showing the second drive space.

2. In terms of the use of the second drive space 112: referring to FIG. 8, the operation method is the same as the above description, the first slide sleeve 30 is pushed to enable the rod member 50 to be smoothly inserted into the channel 11 of the body 10 and make one of the positioning concaves 51 of the rod member 50 be positioned by the first steel ball 21 while making the magnet 51 of the magnetic end 52 locate adjacent to the second drive space 112, by such arrangements, the second drive space 112 can be engaged with a corresponding size (¼ inch) of screw, and the rod member 50 which extends out of the channel 11 of the body can be driven by the drive tool (not shown) to perform the disassembling/assembling operation.

Figure 9:
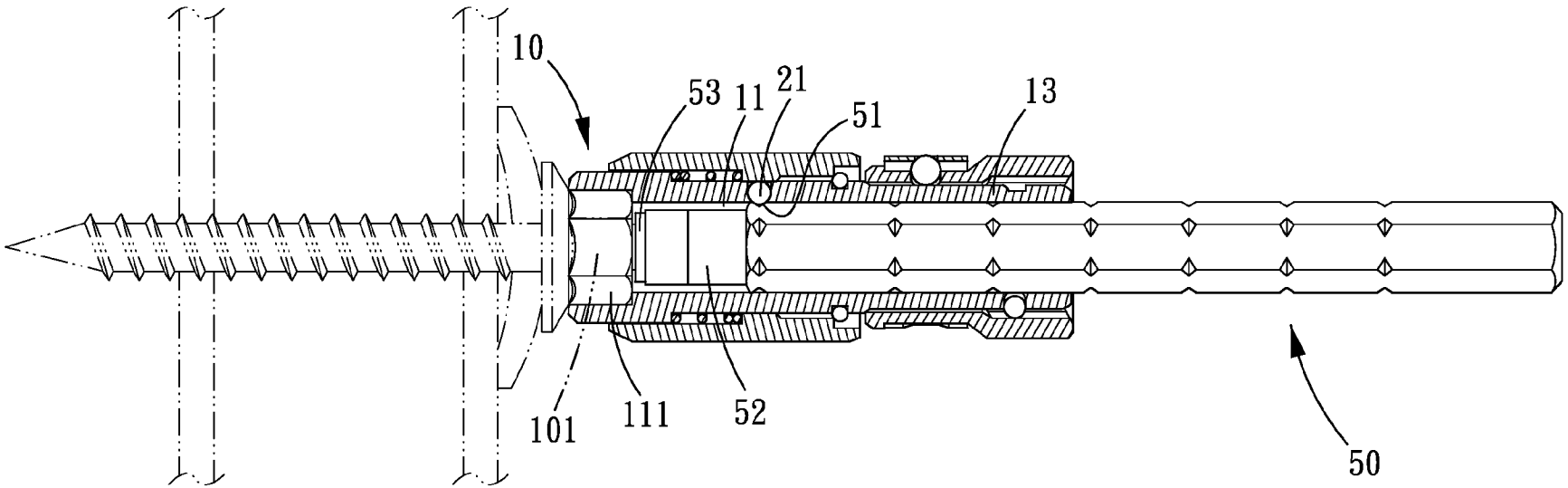
FIG. 9 is a fourth operational view of the versatile tool in accordance with the first embodiment of the present invention, showing the first drive space.

3. In terms of the use of the first drive space 111: referring to FIG. 9, the operation method is the same as the above, so further explanations will be omitted. The difference in operation is that: the magnetic end 52 of the rod member 50 is inserted toward the second drive portion 13 into the channel 11 to position the first steel ball 21 into a different positioning concave 51 of the rod member 20, likewise, when the rod member 50 is positioned into the channel 11 of the body 10, the magnet 53 will be required to locate adjacent to the first drive space 111, hence, the first drive space 111 can be used to engage with a corresponding size of screw 101 (⅝ inch), so that the versatile tool of the present invention can perform the disassembling/assembling operating by cooperating with the drive tool (not shown).

As known from the above description, the versatile tool of the present invention can be applied to assemble and disassemble different sized screws without preparing different sized assembling/disassembling tools. Hence, the present invention can simplify the preparation procedure while reducing the carrying weight.

Figure 10:
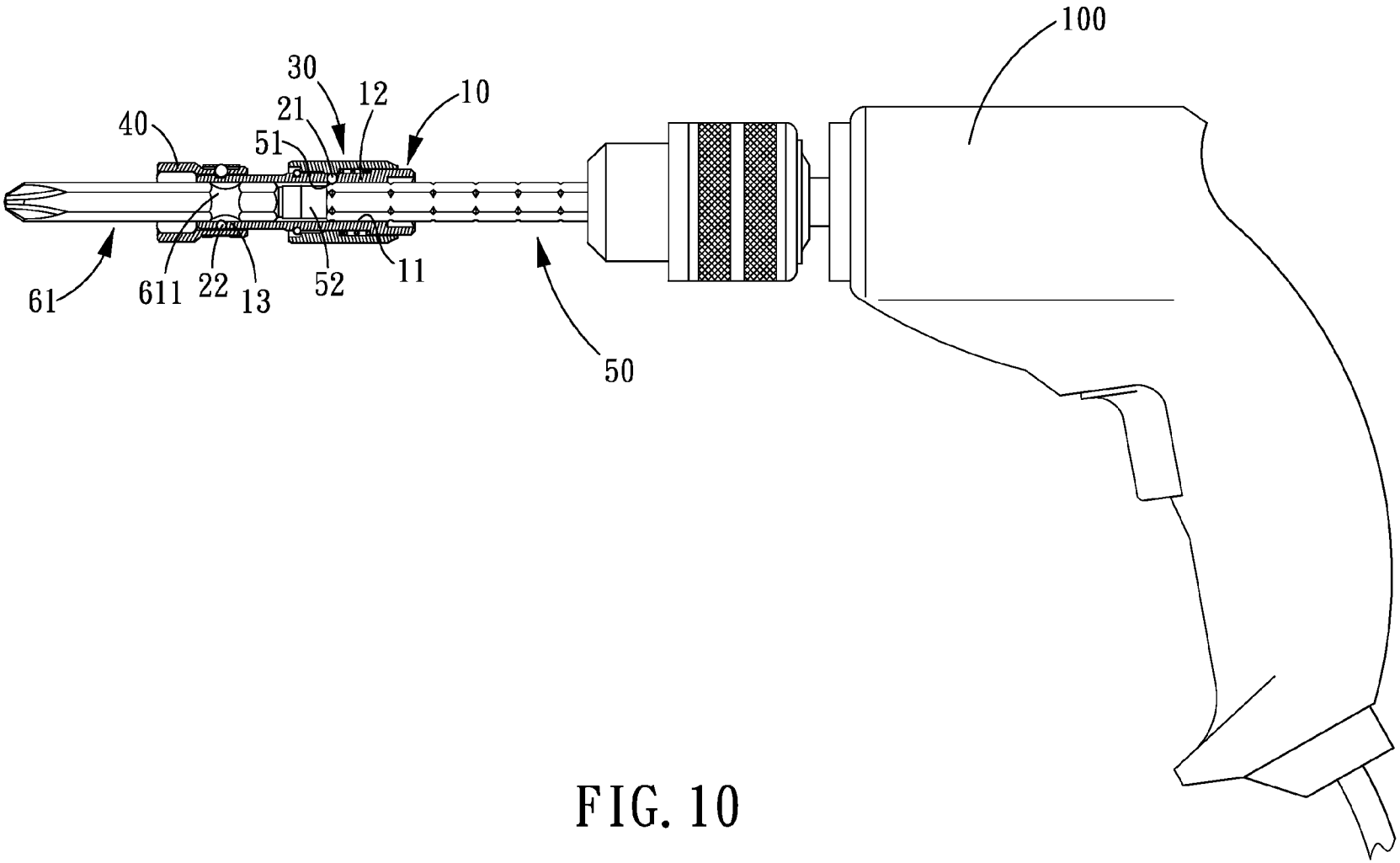
FIG. 10 shows that the versatile tool in accordance with the first embodiment of the present invention cooperates with a cross-shaped tool head.

It is to be noted that, besides being used to disassemble/assemble different sized screws, the present invention can also be used to cooperate with different forms of tool heads, or drills to increase its functions, and its corresponding cooperation manners are described as follows:

1. The operation state of the present invention cooperating with a cross-shaped tool head: referring to FIG. 10, the first slide sleeve 30 is pushed in such a manner that the magnetic end 52 of the rod member 50 is inserted toward the first drive portion 12 of the body 10 into the channel 11 to make one of the positioning concaves 51 of the rod member 50 be positioned by the first steel ball 21, at this moment, a cross-shaped tool head 61 has its fixing concave 611 inserted into the channel 11 toward the second drive portion 13 of the body 10, subsequently, the second slide sleeve 40 will be pulled to position the second steel ball 22 into the fixing concave 611 of the tool head 61 to limit the axial movement of the tool head 61 in the body 10, avoiding the slippage of the tool head 60 from the body 10. By such arrangements, the present invention can be used to assemble or disassemble the cross-shaped working objects after the rod member 50 which extends out of the body is combined to the drive tool 10.

Figure 11:
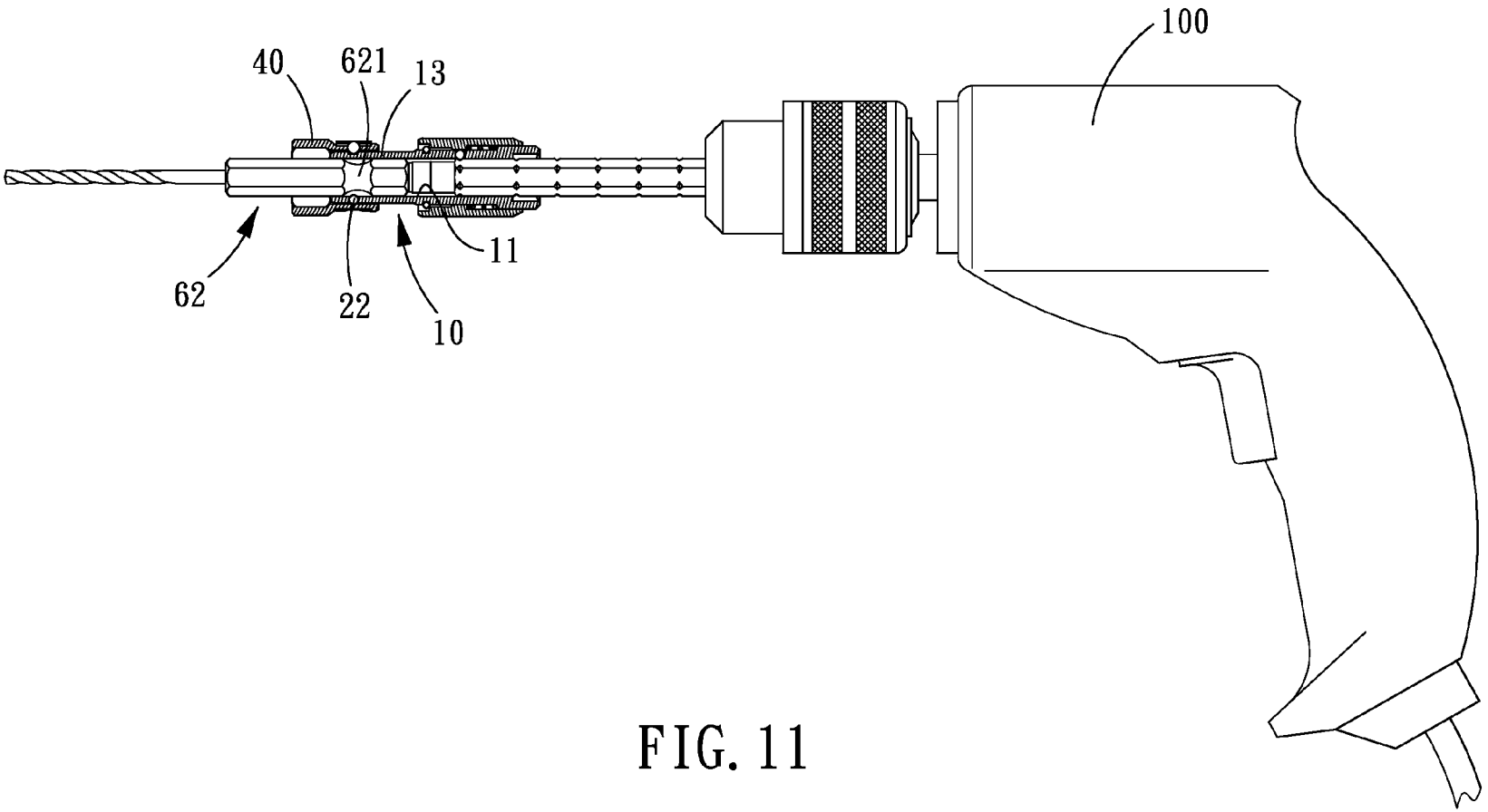
FIG. 11 shows that the versatile tool in accordance with the first embodiment of the present invention cooperates with a drill.

2. The operation state of the present invention cooperating with a drill: referring to FIG. 11, a drill 62 has its fixing concave 621 inserted into the channel 11 toward the second drive portion 13 of the body 10, and then the second slide sleeve 40 will be pulled to position the second steel ball 22 into the fixing concave 621 of the tool head 60, avoiding the slippage of the drill 62 from the body. By such arrangements, the present invention can perform the drilling operation after being combined to the drive tool 100.

Figure 12:
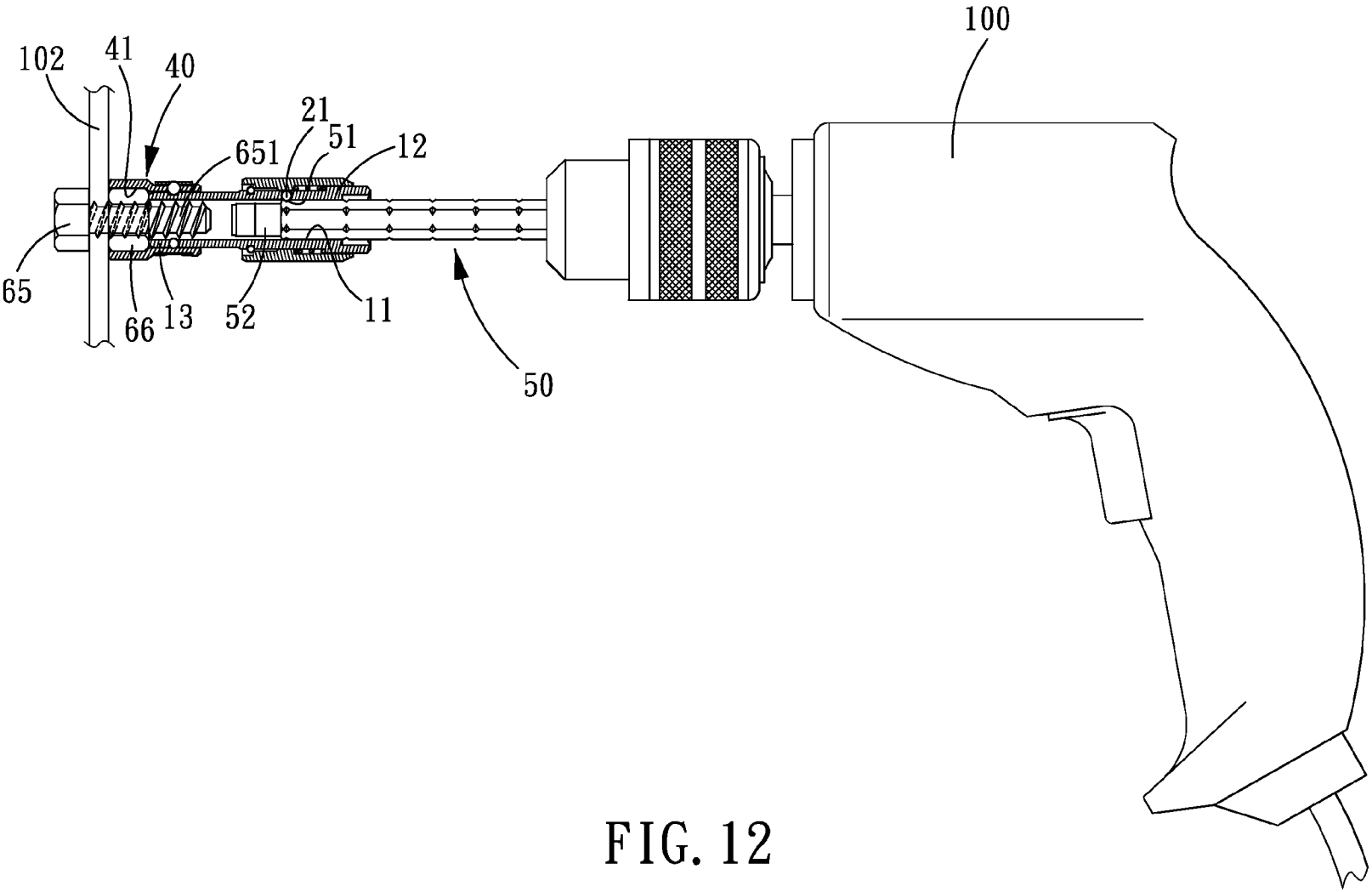
FIG. 12 shows that the versatile, tool in accordance with the first embodiment of the present invention, is used to disassemble a nut in a special case.

3. The operation state of the present invention in special condition: referring to FIG. 12, when the present invention is used to disassemble a nut from an object 102 which is combined with a screw 62 and a nut 66, in some cases, the nut 66 is located a distance away from the end surface of the body portion 651 of the screw 65, the magnetic end 52 of the rod member 50 will be inserted into the channel 11 toward the first drive portion 12 of the body 10 to make the positioning concave 51 of the rod member 50 be positioned by the first steel ball 21, subsequently, the second slide sleeve 40 will be pulled outwards toward the second drive portion 13 of the body 10 to make the third drive space 41 protrude out of the second drive portion 13 of the body 10. By such arrangements, the third drive space 41 can be used to engage onto the nut 66, and the body portion 651 of the screw 65 which extends out of the nut 66 can be inserted into the channel 11 of the body 10, so that the present invention can disassemble the nut 66 by cooperating with the drive tool 100.

Figure 13:
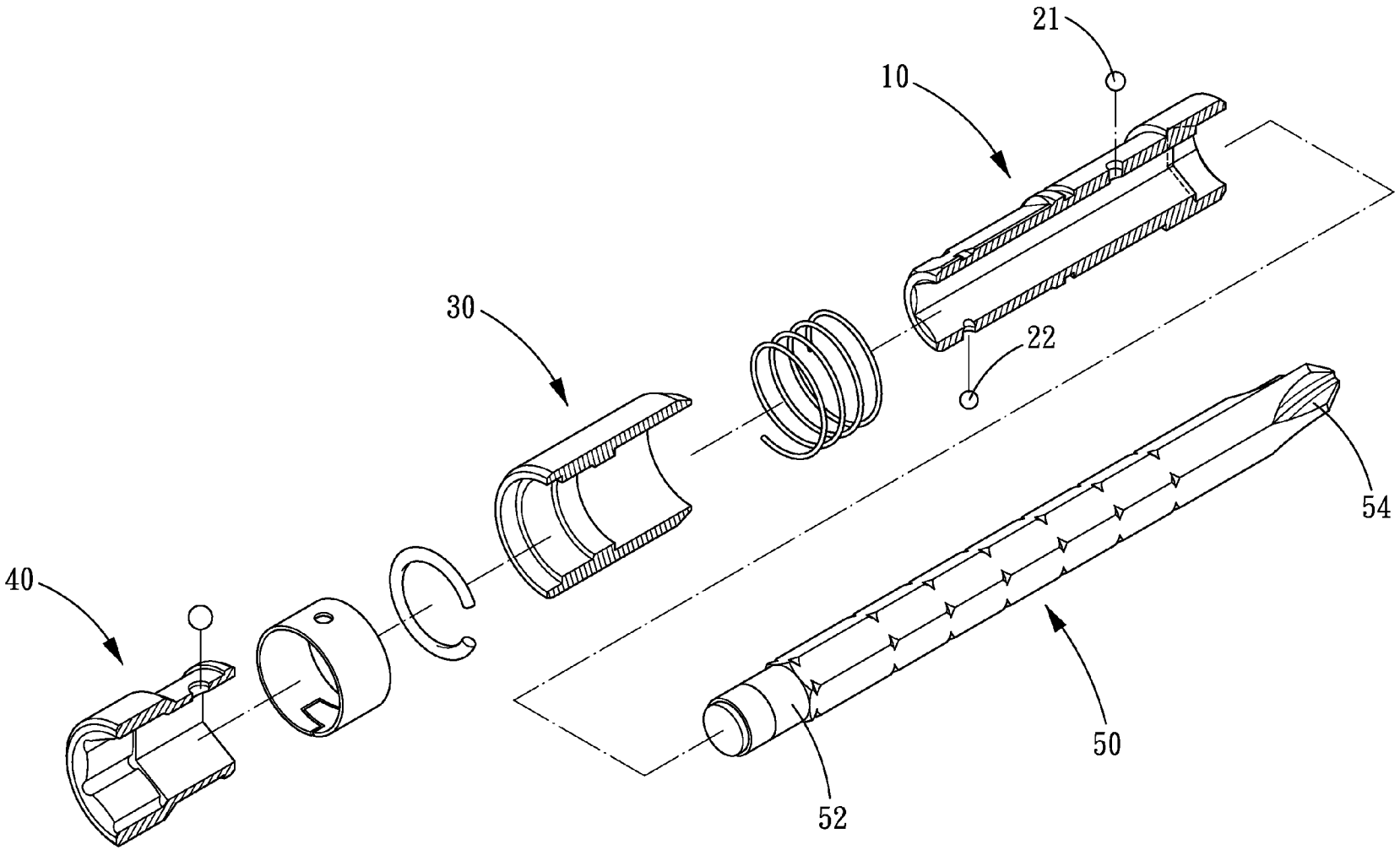
FIG. 13 is an exploded view of a versatile tool in accordance with a second embodiment of the present invention.
Figure 14:
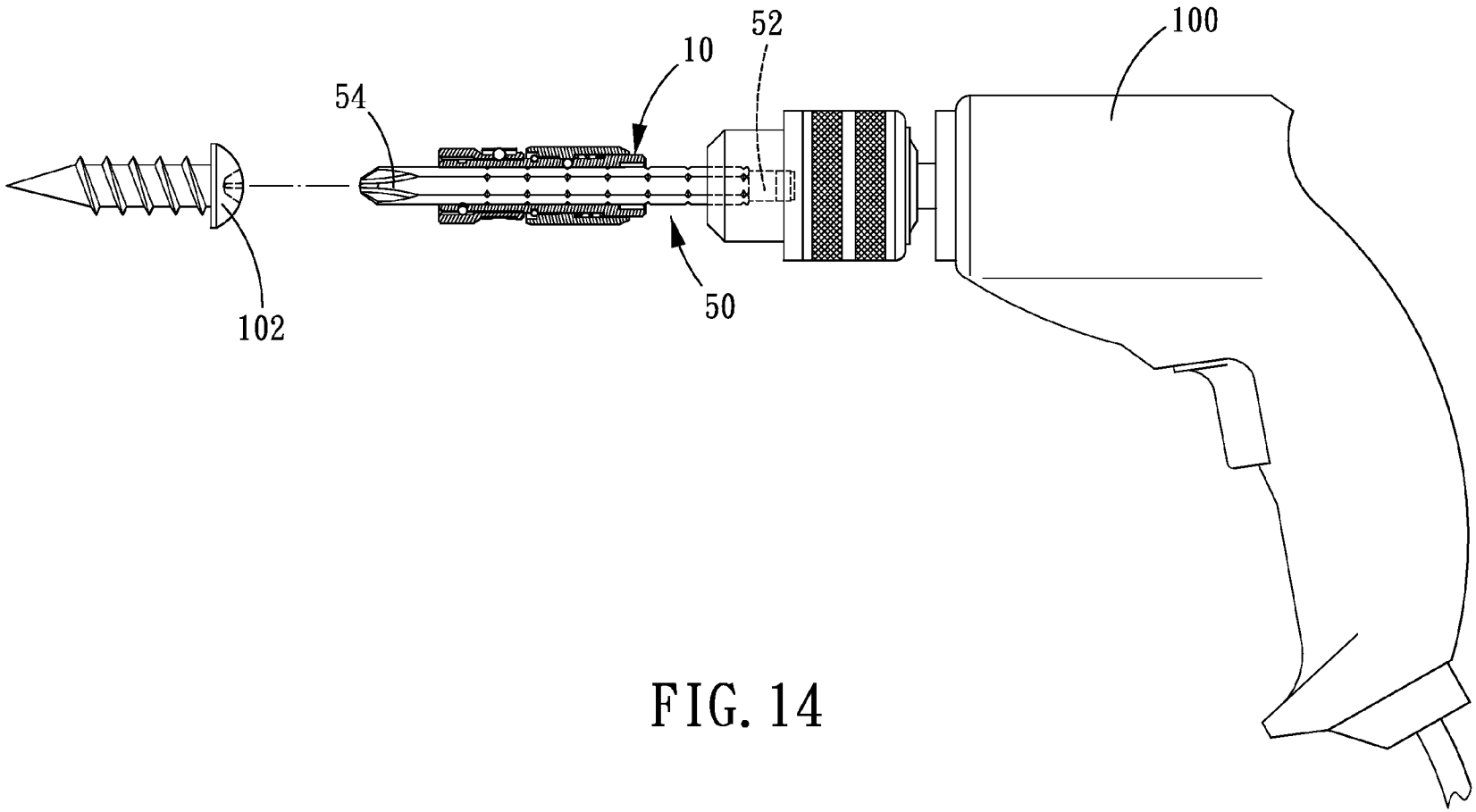
FIG. 14 is a schematic view showing the use of the versatile tool in accordance with the second embodiment of the present invention.

Please refer to FIGS. 13-14, a versatile tool in accordance a second embodiment of the present invention is also driven by a drive tool 100 and comprises body 10, a first steel ball 21, a first slide sleeve 30, a second steel ball 22, a second slide sleeve 40 and a rod member 50. Because the configuration and the functions of the second embodiment of the present invention are the same as that of the first embodiment, further explanation will be omitted. The difference between the second embodiment and the first embodiment of the present invention is described as follows.

The rod member 50 is provided with a working end 54 opposite the magnetic end 52, and the working end 54 is in a shape selected from the group consisting of cross shape, line shape, hexagon, quadrangle, etc. In the present embodiment, the working end 54 is cross-shaped, and since the line-shaped, hexangular, quadrangular working heads are common, no corresponding drawings are provided herein. The rod member 50 can be positioned in the body 10 with its magnetic end 52 and working end 54 both protruding out of the body 10, so that the present invention can assemble and disassemble the cross-shaped screw 103. Therefore, the present invention can assemble or disassemble screws with different shapes of heads.

Figure 15:
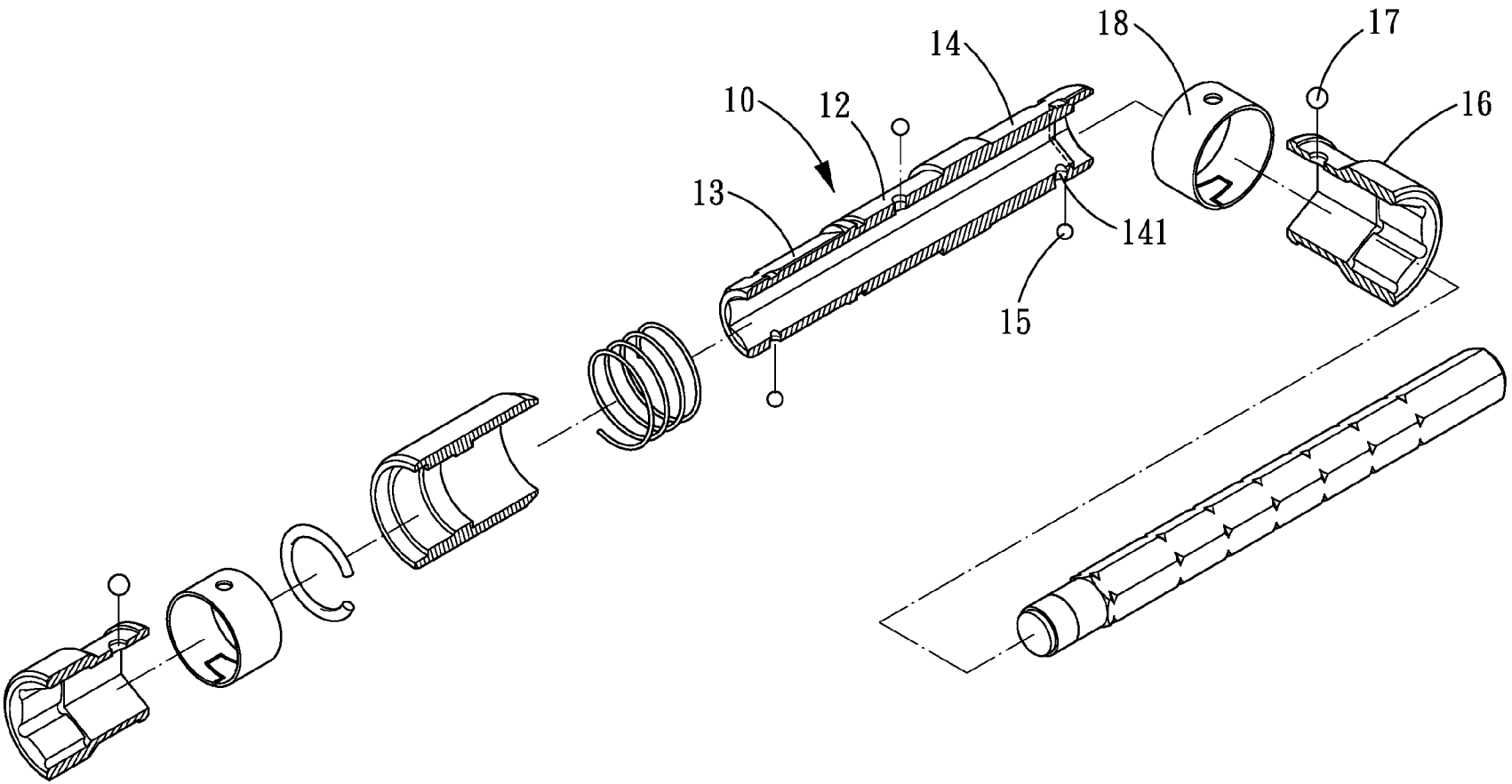
FIG. 15 is an exploded view of a versatile tool in accordance with a third embodiment of the present invention.

It is to be noted that, referring to FIG. 15 illustrating a versatile tool in accordance third second embodiment of the present invention, the body 10 is formed with a third drive portion 14 extending from an end surface of the first drive portion 12, and the third drive portion 14 is symmetrical to the second drive portion 13 and also includes a through hole 141 for movable accommodation of a fourth steel ball 15. On an outer periphery of the third drive portion 14 is engaged a third slide sleeve 16 on which are movably disposed a fifth steel ball 17 and an elastic bind ring 18. Since the operation method of the present embodiment is the same as the first embodiment, further explanation will be omitted herein.

While we have shown and described various embodiments in accordance with the present invention, it is clear to those skilled in the art that further embodiments may be made without departing from the scope of the present invention.

The invention claimed is:

1. A versatile tool being driven by a drive tool and comprising:

body including an axial through channel, the through channel being provided at both ends thereof with a first drive space and a second drive space that are hexagonal in cross section, on an outer periphery of the channel being provided a first drive portion and a second drive portion opposite to the first drive space and the second drive space, the second drive portion being hexagonal in cross section and defined with a through hole in an end corner thereof;

a second steel ball being movably assembled in the through hole of the second drive portion of the body and capable of protruding into the channel;

a first steel ball being movably assembled in the first drive portion of the body and capable of protruding into the channel;

a first slide sleeve including an annular protrusion and being elastically engaged on the first drive portion of the body, and the annular protrusion being capable of pushing against the first steel ball;

a second slide sleeve being interiorly defined with a third drive space that is hexagonal in cross section, and an annular pushing portion, the third drive space and the pushing portion being arranged in a stepped manner, a radial size of the third drive space being greater than a radial size of the annular pushing portion, annular pushing portion of the second slide sleeve being slidably engaged on the second drive portion of the body in such a manner that a moving space is defined between the third drive space and the second drive portion for movement of the second steel ball, the annular pushing portion being capable of pushing against the second steel ball, and the third drive space being capable of protruding from the second drive portion of the body;

a rod member being axially defined with more than one positioning concave and including a magnetic end, one portion of the rod member being located in the channel of the body in such a manner that the positioning concave is positioned by the first steel ball, and the other portion of the rod member extending out of the channel of the body for connection to the drive tool;

by such arrangements, when the rod member enters the channel from the first drive portion of the body to make the positioning concave be positioned by the first steel ball and the magnetic end locate adjacent to the second drive space or the third drive space, the second drive space or the third drive space will be used to engage with a working object, when the rod member enters the channel from the second drive portion of the body to make the positioning concave be positioned by the first steel ball and the magnetic end locate adjacent to the first drive space, the first drive space will be used to engage with a working object.

2. The versatile tool as claimed in claim 1, wherein the magnetic end of the rod member is formed by fixing a magnet on one end of the rod member.

3. The versatile tool as claimed in claim 1, wherein the magnetic end of the rod member is formed by magnetization of one end of the rod member.

4. The versatile tool as claimed in claim 1, wherein the rod member is further provided with a working end opposite the magnetic end, and the working end is in a shape selected from the group consisting of cross shape, line shape, hexagon, quadrangle.

5. The versatile tool as claimed in claim 1, wherein the rod member is hexangular in cross section, the more than one positioning concave is formed in each of end corners on an outer periphery of the rod member.

6. The versatile tool as claimed in claim 1, wherein the third drive space of the second slide sleeve includes a groove in an end corner of an inner periphery thereof, the groove corresponds to the second steel ball.

* * * * *